United States Patent [19]

Bivins

[11] Patent Number: 5,033,612

[45] Date of Patent: Jul. 23, 1991

[54] EYEGLASS AND SCARF HOLDER

[76] Inventor: Elaine Bivins, 39-40 46th St., New York, N.Y. 11104

[21] Appl. No.: 541,728

[22] Filed: Jun. 21, 1990

[51] Int. Cl.[5] ..... A45C 11/04; A44B 21/00; A45F 5/02

[52] U.S. Cl. ..... 206/5; 24/3 C; 24/3 R

[58] Field of Search ..... 206/5; 24/3 C, 3 R, 24/3 G, 3 E

[56] References Cited

U.S. PATENT DOCUMENTS

| | | | |
|---|---|---|---|
| 305,185 | 9/1884 | Hawkes | 24/3 G |
| 4,452,354 | 6/1984 | Tabachnick | 206/5 |
| 4,458,384 | 7/1984 | Arnold | 206/5 X |
| 4,771,515 | 9/1988 | Guarro | 206/5 X |

*Primary Examiner*—William I. Price

[57] ABSTRACT

An eyeglass holder that can be attached to the clothing of the wearer. The eyeglass holder includes a main body having an opening formed in its central portion, a clothing fastener attached to the rear of the main body and above the opening, and a substantially tubular temple holding means attached to the rear of the main body below the opening. Thus a temple of the eyeglasses can be inserted into the holder from the front of the main body by passing the temple through the opening to the temple holding means. The temple holding means is preferably formed having a funnel-shaped vertical transverse cross-section.

9 Claims, 1 Drawing Sheet

EYEGLASS AND SCARF HOLDER

BACKGROUND OF THE INVENTION

The present invention generally relates to devices for temporarily holding a pair of eyeglasses and the like. More particularly, the present relates to eyeglass holders that can be attached to clothing.

Wearers of eyeglasses often desire to temporarily remove the eyeglasses from their face. A recurring problem for such removal is finding a secure place for the eyeglasses that is readily accessible. The prior art has taught means for temporarily holding eyeglasses that are attachable to the clothing or hair of the wearer. While the present invention may be adapted for attachment to the wearer's hair, the most relevant prior art includes the eyeglass holders that can be attached to the wearer's clothing.

Various types of these eyeglass holders have been disclosed in the prior art. In U.S. Pat. No. 305,185 to Hawkes an eyeglass case having clothing fastening means attached thereto is shown. Eyeglass holders that engage the bridge of a pair of eyeglasses are also disclosed in the prior art. Exemplary of this type of eyeglass holder are U.S. Pat. No. 727,204 to Rogers; U.S. Reissue Pat. No. 12,771 to Dripps; U.S. Pat. No. 2,637,080 to Nemser; and U.S. Pat. No. 2,876,513 to McIntosh. Eyeglass holders substantially formed from wire frame members have also been disclosed in the prior art. U.S. Pat. No. 171,681 to Meyer discloses a wire frame having paired clamp hooks which engage the lens frames of the eyeglasses. U.S. Pat. No. 730,663 to Jordan discloses an eyeglass holder having a bent hook attached to a hair pin. In U.S. Pat. No. 3,956,795 to Kosakai an ornamental brooch having a slidably mounted wire frame attached to the rear surface of the brooch and extending downwardly therefrom for receipt of the temples of eyeglasses is shown. A curved wire frame eyeglass holder having end loops that engage the temples of eyeglasses is disclosed in U.S. Pat. No. 4,458,384 to Arnold. A further example of the prior art is shown in U.S. Pat. No. 2,818,621 to Pretz where an eyeglass holder having a tubular member pivotally disposed below an ornamental pin for receipt of the temple of eyeglasses is disclosed.

As can be seen from the foregoing, numerous devices have been considered to provide means for temporarily holding a pair of eyeglasses to clothing and the like. However, these devices of the prior art do not provide the advantages of the present invention. For an eyeglass holder to be most effective it must be capable of receiving the eyeglasses with minimal effort by the wearer and it must retain the eyeglasses within the holder in a secure position. Also, it is desirable that the eyeglass holder be inexpensive to manufacture. These requirements are met by the eyeglass holder of the present invention.

SUMMARY OF THE INVENTION

The present invention is a holder for a pair of eyeglasses which is attachable to the clothing of the wearer. The holder includes an ornamental main body, clothing fastening means attached to the rear surface of the main body and temple holding means attached to the rear surface of the main body below the fastening means. An opening is formed in the ornamental main body between the fastening means and the holding means and thus a temple of the eyeglasses can be inserted through the opening formed in the main body to engage the temple holding means. The holding means is preferably formed having a funnel-shaped vertical transverse cross-section.

An object of the present invention is to provide an eyeglass holder that can be attached to the wearer's clothing.

It is also an object of this invention to provide an eyeglass holder that receives a temple of the eyeglasses and retains the eyeglasses in place without them jiggling or sliding within the holder.

Another object of the present invention is to provide an eyeglass holder that can readily receive the temple of the eyeglasses.

A further object of the present invention is to provide an eyeglass holder wherein the eyeglasses may be placed from the front portion of the holder.

A still further object of this invention is to provide a means of holding a scarf, handkerchief or the like where it can be easily accessed.

These and other objects and advantages of the eyeglass holder of the present invention will be apparent to those skilled in the art from the following description of a preferred embodiment, drawings and appended claims.

DESCRIPTION OF A PREFERRED EMBODIMENT

Figure 1:
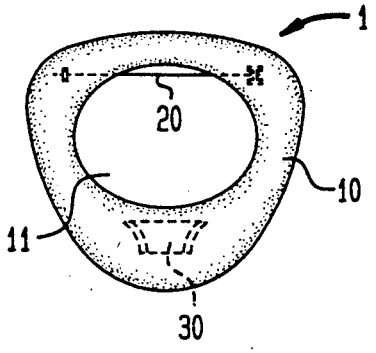
FIG. 1 is a front plan view of the eyeglass holder of the present invention.

FIG. 1 illustrates in a front plan view a preferred embodiment of the eyeglass holder 1 of the present invention. Eyeglass holder 1 includes a main body 10, clothing fastening means 20 and temple holding means 30. Main body 10 is formed in a substantially oval, ornamental shape having an opening 11 formed in the central portion of main body 10. The shape and ornamental design of main body 10 is limited only by the creative imagination of the designer. However, in the preferred embodiment of the present invention, main body 10 includes an opening 11, which itself may vary in shape, that is at least as wide as the top portion of the temple holding means 30.

Clothing fastening means 20 is a conventional safety catch pin 20 having a pin 21, a pivot 22 attached to one end of pin 21 and a lockable ear 23 which receives the opposite end of pin 21 in selectively lockable engagement. This type of safety catch pin 20 is widely known in the art and further description of the catch pin 20 is not deemed instructive. Catch pin 20 is attached to the upper portion of the rear surface 12 of main body 10. As can be seen from the several figures of the present disclosure, the pin 21 of catch pin 20 may transverse the upper portion of the opening 11 in main body 10 without departing from the spirit and scope of the present invention.

Figure 2:
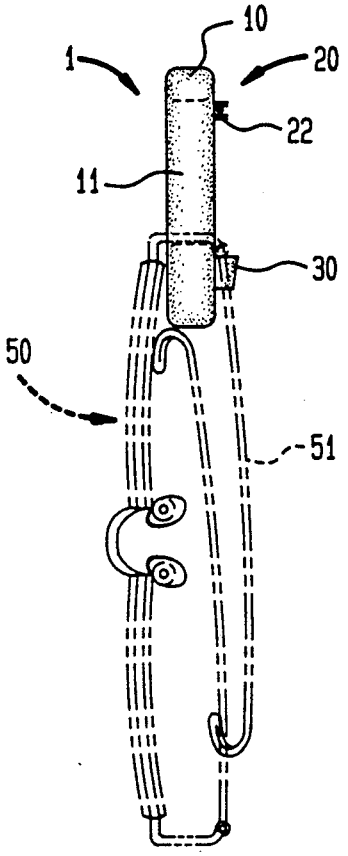
FIG. 2 is a side plan view of the eyeglass holder shown in FIG. 1.
Figure 3:
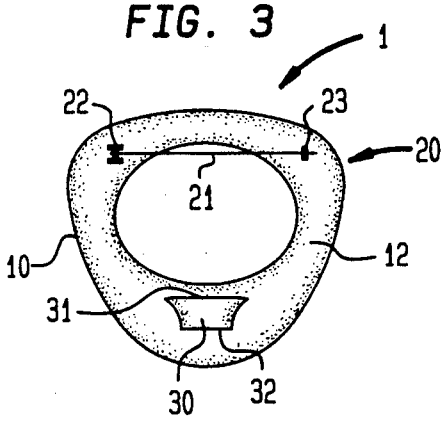
FIG. 3 is a rear plan view of the eyeglass holder shown in FIG. 1.

Temple holding means 30 is attached to the lower portion of the rear surface 12 of main body 10 below the opening 11. As illustrated in the side plan view of the eyeglass holder 1 shown in FIG. 2, a temple 51 of a pair of eyeglasses 50 is inserted through opening 11 to temple holding means 30 to secure the eyeglasses 50 within eyeglass holder 1. Temple holding means 30 is substantially an outwardly-curved plate member having a wide upper end 31 and a narrow lower end 32, the respective ends 31, 32 of the temple holding means 30 being open and in communication through the body of temple holding means 30. The side edges of the temple holding means 30 are attached to the rear surface 12 of the main body 12 thereby forming a funnel-shaped temple holding means 30.

Figure 4:
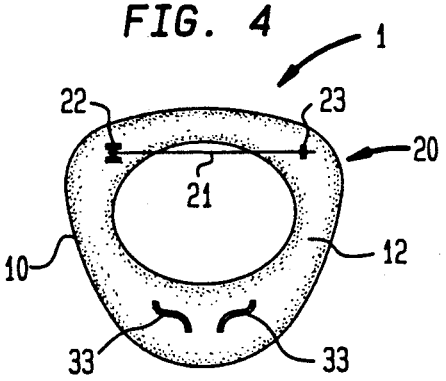
FIG. 4 is a rear plan view of the eyeglass holder of the present invention showing a vertical cross-sectional view of the temple holding means.
Figure 5:
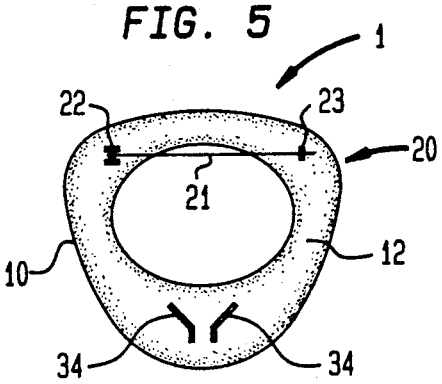
FIG. 5 is a rear plan view of an alternative embodiment of the temple holding means.

As shown in FIG. 4 the funnel shape of temple holding means 30 may also be formed by inwardly-curved side walls 33, or as shown in FIG. 5 the funnel shape of temple holding means 30 may alternatively be formed by angularly juxtaposed planar side walls 34.

The eyeglass holder 1 of the present invention provides means to temporarily store a pair of eyeglasses 50 that is easily used and that provides secure holding of the eyeglasses 50 once inserted therein. A temple 51 of the eyeglasses 50 is inserted through opening 11 formed in main body 10 of the holder 1 to the temple holding means 30. The wide upper end 31 of the temple holding means 30 facilitates engagement of the temple 51 with the holding means 30. The narrow lower end 32 of holding means 30 facilitates secure engagement of the inserted temple 51 by preventing the temple 51 from sliding or jiggling within the holding means 30.

Various changes, modifications, additions and the like can be made to the preferred embodiment of the present invention without departing from the spirit and scope of the disclosure. Such changes, modifications, additions and the like are intended as part of the present disclosure as held in the following claims.

Therefore, in view of the foregoing I claim:

1. An eyeglass holder for a pair of eyeglasses having one or a plurality of temples, said holder being fastenable to clothing and the like, comprising an ornamental main body;

fastening means attached to said main body providing means to attach said holder to clothing and the like; and holding means attached to said main body, said holding means comprising a tubular member having both ends open and a funnel shaped vertical transverse cross-section.

2. An eyeglass holder as described in claim 1 wherein the wide portion of said funnel-shaped tubular member is disposed upwardly and the narrow portion of said tubular member is disposed downwardly.

3. An eyeglass holder as described in claim 2 wherein the funnel-shaped vertical transverse cross-section of said tubular member is formed by side walls disposed in spaced relationship having a first flat surface oriented at an angle relative to a vertical plane of the main body integrally formed at the lower end of said first flat surface with a second flat surface oriented parallel to a vertical plane of the main body.

4. An eyeglass holder as described in claim 2 wherein the funnel-shaped vertical transverse cross-section of said tubular member is formed by a pair of inwardly curving side walls disposed in spaced relationship.

5. An eyeglass holder for a pair of eyeglasses having one or a plurality of temples, said holder being fastenable to clothing and the like, comprising an ornamental main body;

fastening means attached to the upper portion of the rear surface of said main body for attaching said holder to clothing and the like;

holding means attached to the lower portion of the rear surface of said main body, said holding means comprising an outwardly curved plate member attached to said main body at the respective side edges of said plate member, said plate member having a wide upper portion and a narrow lower portion.

6. An eyeglass holder as described in claim 5 wherein the plate member is formed having a funnel-shaped inner surface.

7. An eyeglass holder as described in claim 5 wherein said ornamental main body includes an opening disposed between said fastening means and said holding means.

8. An improvement in an eyeglass holder of the type having fastening means attached to the rear surface of an ornamental body and holding means attached to the rear surface of said main body below said fastening means, said improvement comprising holding means having a funnel-shaped vertical transverse cross-section.

9. An eyeglass holder for a pair of eyeglasses having one or a plurality of temples, said holder being fastenable to clothing and the like, comprising a main body having an ornamental front surface and an opening formed in the central portion of said main body;

fastening means attached to the upper portion of the rear surface of said main body above said opening for attaching said holder to clothing and the like;

holding means attached to the lower portion of the rear surface of said main body below said opening, said holding means comprising a plate member outwardly curved from the main body and attached to said main body at the respective side edges of said plate member, said plate member having a wide upper portion and a narrow lower portion;

thereby providing means to insert a temple of the eyeglasses into the holding means from the front of the main body of the holder.

* * * * *